US007125071B2

(12) United States Patent
Aiudi

(10) Patent No.: US 7,125,071 B2
(45) Date of Patent: Oct. 24, 2006

(54) CARRYING STRAP

(76) Inventor: Michael Aiudi, 194 Lakewood Rd., South Glastonbury, CT (US) 06073

( * ) Notice: Subject to any disclaimer, the term of this patent is extended or adjusted under 35 U.S.C. 154(b) by 0 days.

(21) Appl. No.: 11/191,702

(22) Filed: Jul. 28, 2005

(65) Prior Publication Data

US 2006/0033365 A1 Feb. 16, 2006

Related U.S. Application Data

(60) Provisional application No. 60/601,730, filed on Aug. 13, 2004.

(51) Int. Cl.
*A47C 1/00* (2006.01)

(52) U.S. Cl. ..... 297/4; 297/250.1; 224/158

(58) Field of Classification Search ..... 297/250.1, 297/183.1, 183.6, 217.1, 463.1, 483, 468, 297/4; 224/158, 258, 264, 576
See application file for complete search history.

(56) References Cited

U.S. PATENT DOCUMENTS 3,322,102 A * 5/1967 Windle ..... 182/3
4,629,103 A * 12/1986 Miller ..... 224/250
5,267,680 A * 12/1993 Torok ..... 224/158
5,307,966 A * 5/1994 Inaba et al. ..... 224/578
5,540,365 A * 7/1996 LaMair ..... 224/158
6,378,746 B1 * 4/2002 Miller ..... 224/258
6,378,937 B1 * 4/2002 Faudman ..... 297/183.1
6,530,129 B1 * 3/2003 Cheng ..... 24/200
6,715,828 B1 * 4/2004 Cheng ..... 297/183.3

* cited by examiner

*Primary Examiner*—Milton Nelson, Jr.
(74) *Attorney, Agent, or Firm*—Alix, Yale & Ristas, LLP

(57) ABSTRACT

Strap for carrying a load from a person's shoulder, comprising a flexible band forming a relatively larger, upper loop for passing over the person's shoulder and a relatively smaller, lower loop for attaching the load, wherein the upper and lower loops are connected to form a figure eight. The lower loop includes a buckle for opening the lower loop to receive the load and closing the lower loop to capture the load within the lower loop. Another embodiment is directed to the combination of (1) an infant seat having a base, a bedding region within the base, and a handle projecting from the base over the bedding region, and (2) a flexible band forming a relatively smaller lower loop including a buckle for opening and closing the lower loop to capture the handle, and a relatively larger, upper loop for passing over the person's shoulder, whereby the infant seat with infant therein is fully supportable from the person's shoulder when the upper loop lies over the person's shoulder.

15 Claims, 3 Drawing Sheets

CARRYING STRAP

RELATED APPLICATION

This application claims priority from U.S. Provisional Application No. 60/601,730 filed Aug. 13, 2004, under 35 U.S.C. Sec. 119(e).

BACKGROUND OF THE INVENTION

In many everyday activities, one is required to hold in one hand and manually carry a heavy or cumbersome object over a considerable distance (such as a piece of carry-on luggage between gates at different sections of an airport terminal) or through a restricted passageway (such as opening a door while holding an infant in a portable seat). The weight of such objects is concentrated through a handle onto the carrier's hand and arm, putting a strain on the lower back and shoulders. Especially while holding an irregularly shaped infant seat, the weight or load is concentrated away from the carrier's body, exacerbating the imbalanced stress on the body.

SUMMARY OF THE INVENTION

It is an object of the present invention to provide a carrying strap that attaches to such a load and distributes all or a portion of the weight onto the carrier's shoulder.

It is a more particular object to provide such a strap that is suitable for attachment to the handle of an infant seat, whereby the full weight of the seat with infant is temporarily supported from the carrier's shoulder, enabling the carrier free use of the hand on the side of that shoulder.

It is yet another object to provide a strap of the foregoing character, that is simple, robust, easy to use, easy to store, and adjustable for different body sizes and types.

In one embodiment, the invention is directed to strap for carrying a load on a person's shoulder, comprising a flexible band forming a relatively larger, upper loop for passing over the person's shoulder and a relatively smaller, lower loop for carrying the load, wherein the upper and lower loops are connected to form a figure eight. The lower loop includes a buckle for opening the lower loop to receive the load and closing the lower loop to capture the load within the lower loop. In another embodiment, the invention is directed to the combination of (1) an infant seat having a base, a bedding region within the base, and a handle projecting from the base over the bedding region, and (2) a flexible band forming a relatively smaller lower loop including a buckle for opening and closing the lower loop to capture the handle, and a relatively larger, upper loop for passing over the person's shoulder, whereby the infant seat with infant therein is fully supportable from the person's shoulder when the upper loop lies over the person's shoulder.

In the preferred embodiment a unitary strip of fabric forms an S that has upper and lower end points with respective end-effectors. A cross member is secured to the strip at a position intermediate the end points. The cross member also includes upper and lower end points with respective end effectors, such that the end effectors on the upper end points of the S and cross member are connected to form the upper loop and the end effectors on the lower end points form the buckle.

In yet a further preference, the end effector on the upper point of the S includes a slide buckle for adjusting the size of the upper loop and the end effector on the upper point of the cross member includes a ring engaging a portion of the strip associated with the slide buckle.

DESCRIPTION OF THE PREFERRED EMBODIMENTS

Figure 1:
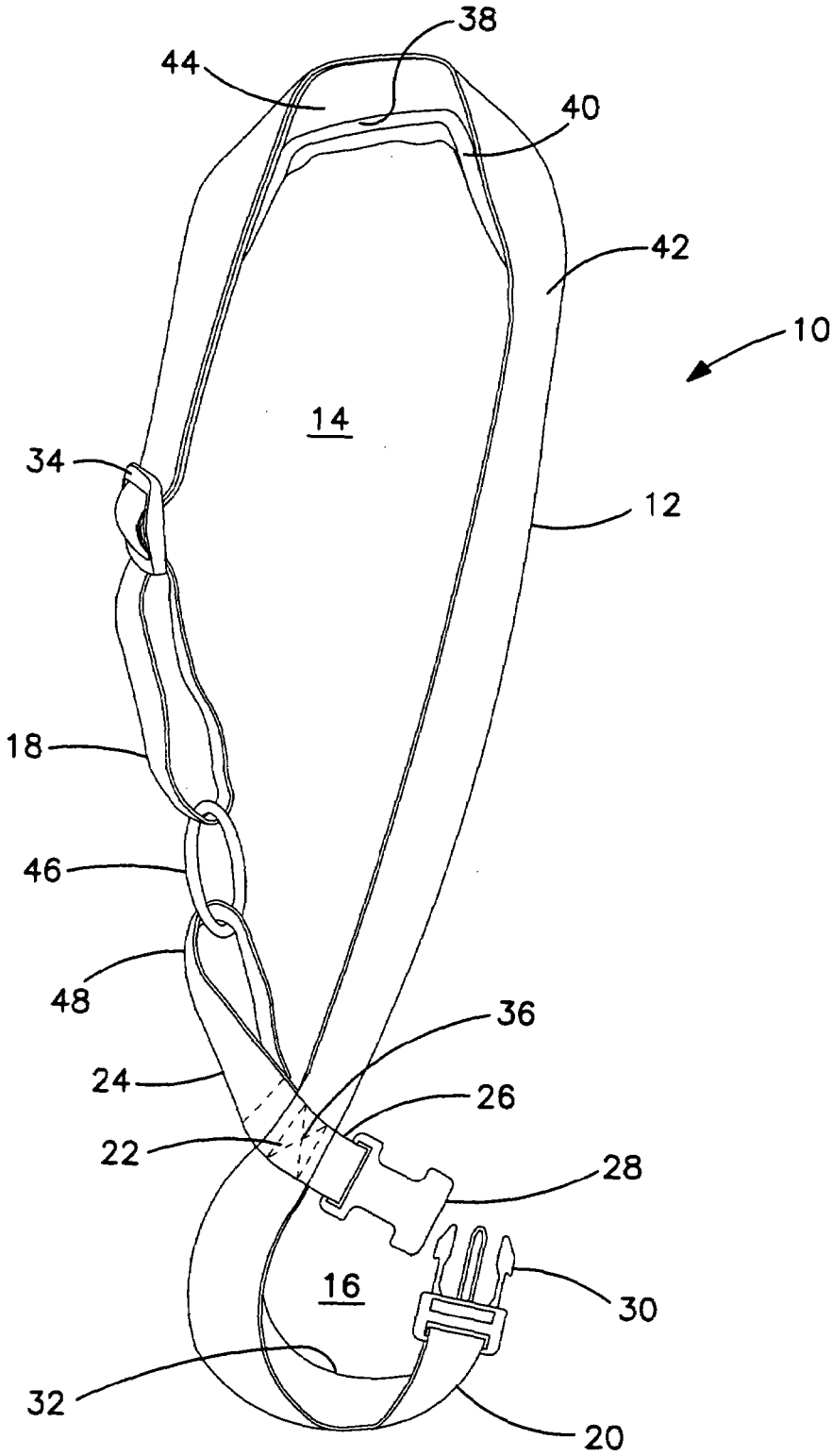
FIG. 1 is a plan view of the preferred embodiment of the inventive carrier strap.

FIG. 1 shows the preferred form of carrying strap 10 comprising a flexible band 12, preferably of woven or unwoven fabric or the like, forming a relatively larger, upper loop 14 and a relatively smaller, lower loop 16. Preferably, the band comprises a first unitary strip that forms an S, defining upper 18 and lower 22 end points. Nearer the lower end point, a cross piece or member 20, preferably forms or crosses at an X, rather than perpendicularly, and has respective upper 24 and lower 26 end points. The lower end points of the cross member and the S band have respective end effectors 28, 30, which can be of any suitable form that can easily be buckled to close the lower loop 16 and support a load hanging from point 32. The upper end of the S band is folded over itself with an adjustment means, such as a slide buckle 34, whereby the upper loop can be enlarged or decreased in size. The cross member is preferably attached to the band, as by stitching 36 or rivets, such that, when the upper loop 14 is placed onto the user's shoulder, the load bearing portion 38 of the upper loop is substantially vertically aligned with the crossing point 36, and the lower support point 32. The band has opposed flat surfaces 40, 42, one of which faces the lower loop and preferably includes a cushion lining 44 at 38 for bearing on the user's shoulder. Preferably, the upper portion of the cross member 22 is folded back and stitched to itself shown at 48, through a metal ring or the like 46, through which the upper end 18 of the band also passes or returns into the slide buckle 34, thereby completing the upper loop 14.

Figure 2:
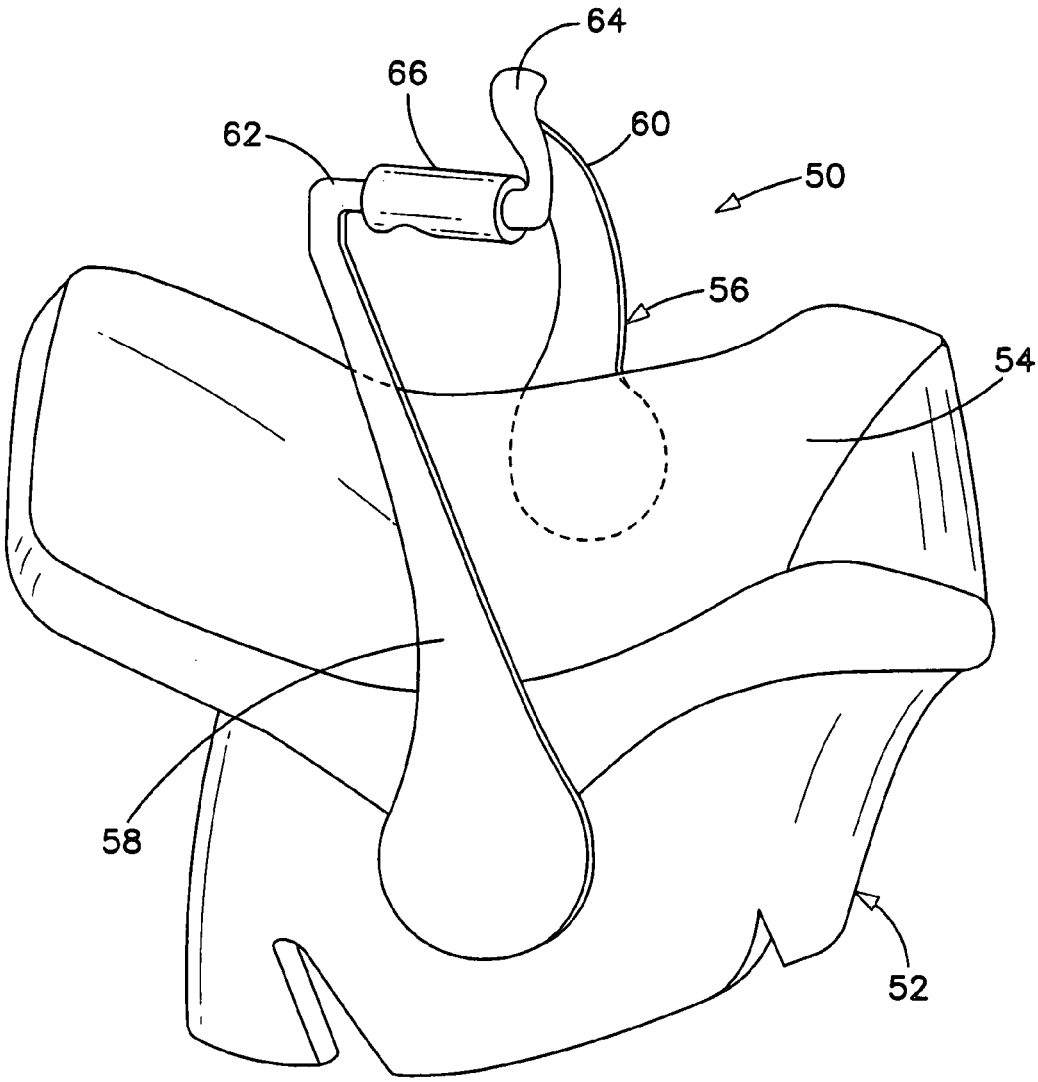
FIG. 2 is a schematic view of an the inventive carrier strap attached to the handle of an infant seat.

FIG. 2 shows a typical infant seat 50, having a base 52, a bed portion 54 within the base, and a handle 56 that is attached to and projects 58, 60 above the base. In this particular seat, the handle has a compound angle at the apex formed by portions 62, 64, to define a grip 66 that better aligns the carrier's hand when the arm is suspended form the shoulder. The invention is not, however, to be limited by the particular infant seat design shown in FIG. 2.

Figure 3:
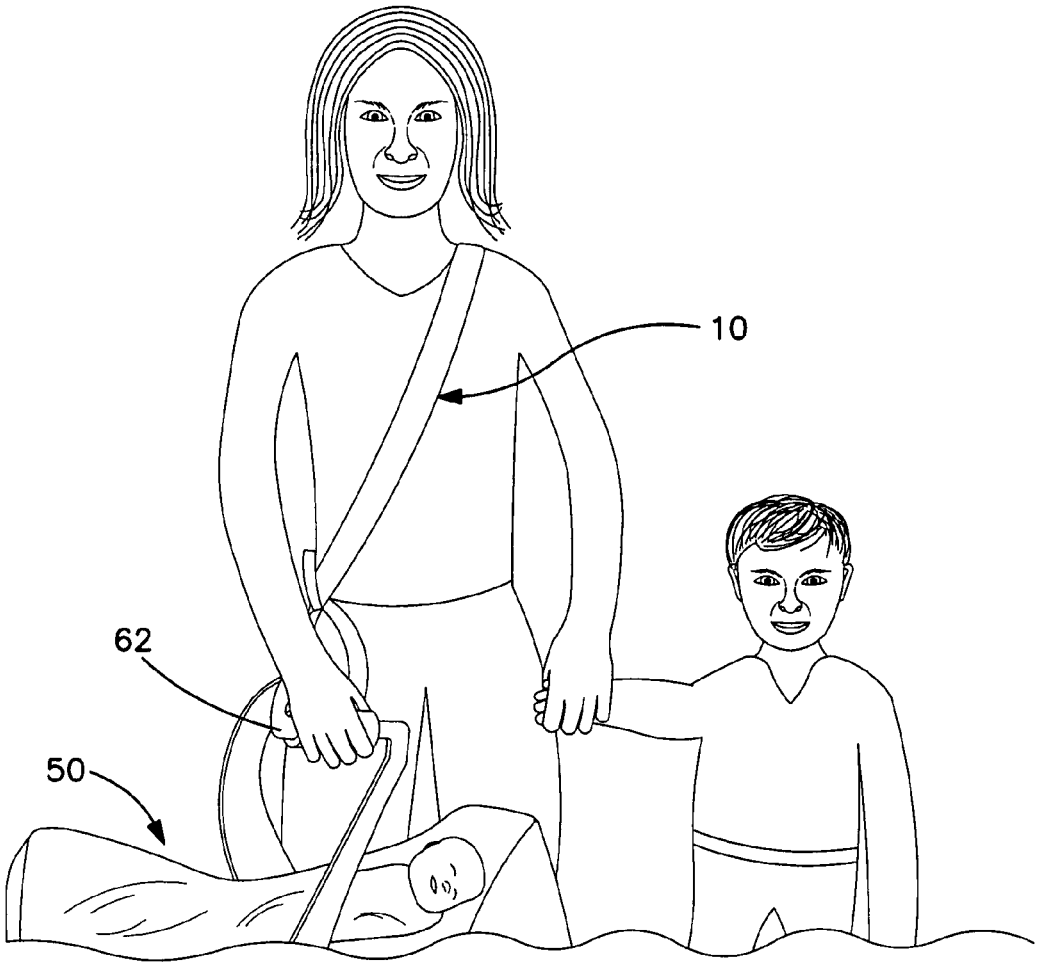
FIG. 3 is a schematic of a woman using the inventive strap in combination with the infant seat of FIG. 2.

FIG. 3 shows a mother holding a toddler by one hand while holding an infant seat 50 in the other hand, as supplemented by a strap 10 according to the invention. It can be appreciated that, for example, in the event the mother and children must pass through a heavy door, the mother can release her grip on the seat handle 62 and reach forward to open the door. Similarly, such freeing up of the hands provides a significant convenience when standing at a cash register or the like. Furthermore, if the group is to walk a considerable distance, the mother can adjust her posture while walking, to shift much of the load of the infant seat to her left shoulder, which is opposite the shoulder associated with the hand holding the grip. While walking, however, the mother should maintain at least a light grip on the seat handle for keeping the seat level.

With the two-loop configuration, the upper loop is adjustable to the user's body shape and size, whereas the lower loop can conveniently be attached to the seat handle. The ease of latching and unlatching of the lower loop is especially advantageous when an infant seat is being placed into or removed from a vehicle. The smaller size of the lower loop and the ease with which the entire strap can be disengaged from the handle and set aside, virtually eliminates the possibility of the strap wrapping around the infant's head while the seat is in the car.

The invention claimed is:

1. A strap for carrying a load on a person's shoulder, comprising;

a flexible band forming a relatively larger, upper loop for passing over the person's shoulder and a relatively smaller, lower loop for carrying said load, wherein the upper and lower loops are connected to form a figure eight and wherein said connection of said upper and lower loops is fixed; and said lower loop includes a buckle for opening the lower loop to receive said load and closing the lower loop to capture said load within the lower loop;

wherein the band forming the upper loop has opposed flat surfaces, one of which faces said lower loop, and said one surface includes a cushion for bearing on the person's shoulder.

2. A strap for carrying a load on a person's shoulder comprising:

a flexible band forming a relatively larger, upper loop for passing over the person's shoulder and a relatively smaller, lower loop for carrying said load, wherein the upper and lower loops are connected to form a figure eight;

a buckle on said lower loop for opening the lower loop to receive said load and closing the lower loop to capture said load within the lower loop;

wherein the flexible band comprises a unitary strip of fabric that forms an S, said S including upper and lower end points with respective end-effectors thereon; and a cross member secured to the strip at a position intermediate said end points, said cross member including upper and lower end points with respective end effectors thereon;

wherein the end effectors on the upper end points of the S and cross member are connected to form the upper loop and the end effectors on the lower end points form said buckle.

3. The strap of claim 2, wherein the end effector on the upper point of the S includes a slide buckle for adjusting the size of the upper loop and the end effector on the upper point of the cross member includes a ring engaging a portion of the strip associated with the slide buckle.

4. The strap of claim 3, wherein the cross member as secured to the strip, forms an X.

5. The strap of claim 4, wherein the band forming the upper loop has opposed flat surfaces, one of which faces said lower loop, and said one surface includes a cushion for bearing on the person's shoulder.

6. Apparatus for carrying an infant from a person's shoulder, comprising:

an infant seat having a base, a bedding region within the base, and a handle projecting from the base over the bedding region;

a flexible band forming a relatively smaller lower loop including a buckle for opening the lower loop to receive said handle and closing the lower loop to capture said handle within the lower loop, and a relatively larger, upper loop for passing over the person's shoulder, whereby the infant seat with infant therein is fully supportable from the person's shoulder when the upper loop lies over the person's shoulder.

7. The apparatus of claim 6, wherein the band forming the upper loop has opposed flat surfaces, one of which faces said lower loop, and said one surface includes a cushion for bearing on the person's shoulder.

8. The apparatus of claim 6, wherein, the band is a substantially flat, unitary strip of fabric that is crossed over itself to form a figure eight and is permanently secured to itself at said crossover; and the upper loop has a slide buckle whereby the size of the upper loop can be adjusted.

9. The apparatus of claim 6, wherein the upper loop includes a slide buckle whereby the upper loop can be enlarged or decreased in size.

10. The apparatus of claim 6, wherein the upper and lower loops are connected to form a figure eight.

11. The apparatus of claim 10, wherein the connection of the upper and lower loops is fixed.

12. The apparatus of claim 6, wherein said band includes, a unitary strip of fabric that forms an S, said S including upper and lower end points with respective end-effectors thereon;

a cross member secured to the strip at a position intermediate said end points, said cross member including upper and lower end points with respective end effectors thereon;

wherein the end effectors on the upper end points of the S and cross member are connected to form the upper loop and the end effectors on the lower end points form said buckle.

13. The apparatus of claim 12, wherein the end effector on the upper point of the S includes a slide buckle for adjusting the size of the upper loop and the end effector on the upper point of the cross member includes a ring engaging a portion of the strip associated with the slide buckle.

14. The apparatus of claim 13, wherein the cross member as secured to the strip, forms an X.

15. The apparatus of claim 14, wherein the band forming the upper loop has opposed flat surfaces, one of which faces said lower loop, and said one surface includes a cushion for bearing on the person's shoulder.

* * * * *